US006868909B2

(12) United States Patent
Murray

(10) Patent No.: US 6,868,909 B2
(45) Date of Patent: Mar. 22, 2005

(54) DRILLABLE JUNCTION JOINT AND METHOD OF USE

(75) Inventor: Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/175,726

(22) Filed: Jun. 20, 2002

(65) Prior Publication Data

US 2002/0195249 A1 Dec. 26, 2002

Related U.S. Application Data

(60) Provisional application No. 60/300,990, filed on Jun. 26, 2001.

(51) Int. Cl.[7] ..... E21B 29/06

(52) U.S. Cl. ..... 166/298; 166/313; 166/50; 166/55; 166/117.5

(58) Field of Search ..... 166/298, 55, 50, 166/313, 117.5, 242.1, 241.1

(56) References Cited

U.S. PATENT DOCUMENTS

| | | | | |
|---|---|---|---|---|
| 4,415,205 A | | 11/1983 | Rehm et al. | |
| 5,301,760 A | | 4/1994 | Graham | |
| 5,615,740 A | | 4/1997 | Comeau et al. | |
| 5,871,046 A | * | 2/1999 | Robison | 166/241.1 |
| 6,012,526 A | * | 1/2000 | Jennings et al. | 166/298 |
| 6,012,527 A | | 1/2000 | Nitis et al. | |
| 6,035,937 A | | 3/2000 | Gano et al. | |
| 6,041,855 A | | 3/2000 | Nistor | |
| 6,073,697 A | | 6/2000 | Parlin et al. | |
| 6,206,111 B1 | | 3/2001 | Nistor | |
| 6,386,287 B2 | * | 5/2002 | George | 166/242.1 |

* cited by examiner

*Primary Examiner*—David Bagnell
*Assistant Examiner*—Matthew J Smith
(74) *Attorney, Agent, or Firm*—Cantor Colburn LLP

(57) ABSTRACT

A drillable junction joint in a wellbore comprises a wellbore casing in which a section of the casing is constructed of easily drillable material. A sleeve having a premachined window therein is disposed within the casing joint and is freely orientable within the casing segment. Further disclosed are methods for installation of the junction joint and for creating an exit.

27 Claims, 3 Drawing Sheets

DRILLABLE JUNCTION JOINT AND METHOD OF USE

CROSS-REFERENCE TO RELATED APPLICATIONS

This application claims the benefit of U.S. Provisional Application Ser. No. 60/300,990 filed Jun. 26, 2001, which is incorporated herein by reference.

BACKGROUND

Modern production hydrocarbon well systems more and more frequently employ multilateral techniques developed to improve hydrocarbon recovery while minimizing surface structures. A multilateral wellbore system includes at least a primary wellbore and a lateral wellbore extending therefrom. It should be understood that the terms "primary" and "lateral" as used in this application are relative terms. "Primary" may mean a borehole extending from the surface or may mean the original lateral borehole from which a secondary lateral borehole is drilled. The term "lateral" borehole is intended to mean the borehole extending from a "primary" borehole as defined above. The point at which the primary wellbore and the lateral wellbore connect is termed a junction.

SUMMARY

An easily drillable casing joint is disclosed that has a portion which is easily drillable such that a standard drill bit is the appropriate tool to open a window therein. A sleeve with a machined window therein is mounted internally to the casing joint.

Also disclosed is a method for drilling a casing exit for a lateral wellbore which comprises running a casing joint that includes an easily drillable section and a sleeve having a premachined window therein. The method includes diverting a standard drill bit through the premachined window in the sleeve and drilling through the easily drillable portion of the casing joint.

BRIEF DESCRIPTION OF THE DRAWINGS

Referring now to the drawings wherein like elements are numbered alike in the Figures.

DETAILED DESCRIPTION

Figure 1:
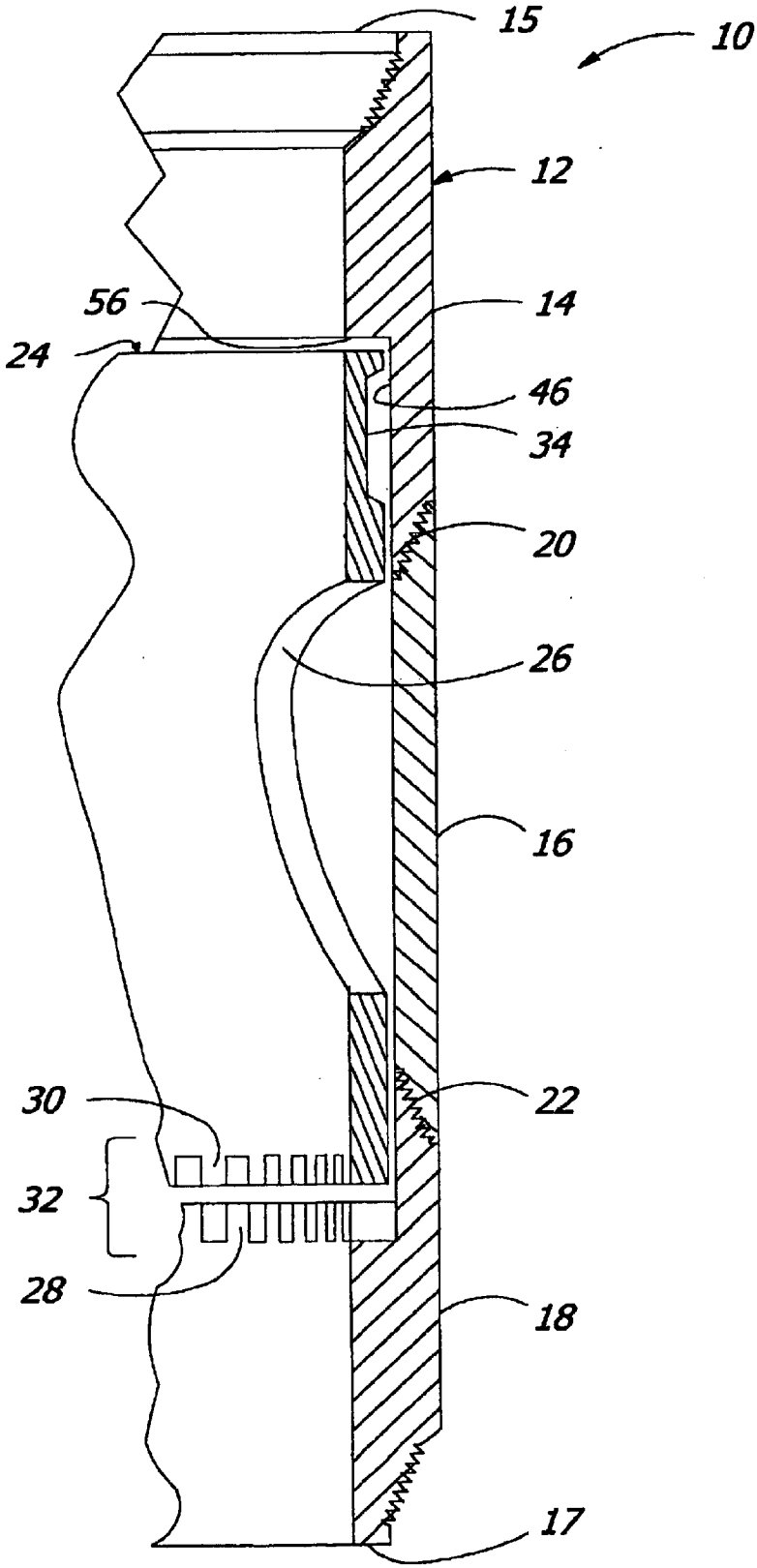
FIG. 1 is a quarter section view of a casing joint having an easily drillable portion and a thin walled sleeve with a pre-machined window in the run in position.

Referring to FIG. 1, an easily drillable junction joint is illustrated. Drillable junction joint 10 comprises a sleeve 24 and a casing segment 12, which comprises three sections. A first section 14, which is located at an uphole end 15 of casing segment 12, is constructed from a conventional casing material such as steel. A second section 16, or middle section, is constructed entirely or partially from a material that can be drilled using standard drilling bits (soft material). Examples of such materials are aluminum, fiber filled plastic, reinforced plastic, phenolic resin and combinations including at least one of the foregoing as well as other materials through which a window can be drilled by a standard drill bit without resort to a milling tool. A third section 18, which is located at a downhole end 17 of casing segment 12, is similar to first section 14 and constructed of a conventional casing material such as steel. First, second and third sections of the joint are connected, in one embodiment, by premium threaded connections illustrated schematically at 20 and 22 in FIG. 1. In the event a second section 16 material is selected which suffers from galling when in contact with steel, any commercially available lubricant may be applied to threads 20, 22 to alleviate or prevent such galling.

The sleeve 24 as noted above, is preinstalled within casing segment 12 so that sleeve 24 fits within a cylindrical recess 46 on the I.D. (inside diameter) of casing segment 12. The recess 46 is desirable, and is dimensioned to facilitate the I.D. of the segment 12 with sleeve 24 therein being the same from end 15 through to end 17. In other words, the I.D. of sleeve 24 is substantially the same as the I.D. of casing segment 12.

Sleeve 24 is preferably constructed of steel with a thickness of about 0.125 inch to about 0.250 inch and of an axial length sufficient to bridge from first section 14 to third section 18 of casing joint 12. The bridging allows the device to gain the benefit of the easily drillable portion of section 16 while alleviating or eliminating any possible drawbacks associated with the employment of drillable material such as degradation thereof over time. Since the sleeve effectively joins first section 14 to third section 18, the junction will remain sealed even if the drillable portion of section 16 degrades over time.

Sleeve 24 further comprises premachined window 26. Window 26, because it is premachined, enjoys a known shape selected to complement a liner such as a hook hanger liner system or lateral seal and control system both of which are commercially available from Baker Oil Tools, Houston, Tex. Thus, upon installation of such liner through the window a good seal is assured. Window 26 is positioned in sleeve 24 so that window 26 will be located at a position relative to second section 16 of casing segment 12 to facilitate a drill string passing through window 26 and exiting the casing in section 16. It will be understood that the timing of window 26 becoming so aligned is not critical providing it is so aligned at the time the drill string is passed therethrough. In other words, window 26 is not necessarily aligned with a drillable portion of section 16 or even with any of section 16 until sleeve 24 is oriented and rotationally locked in place (discussed hereunder).

Figure 2:
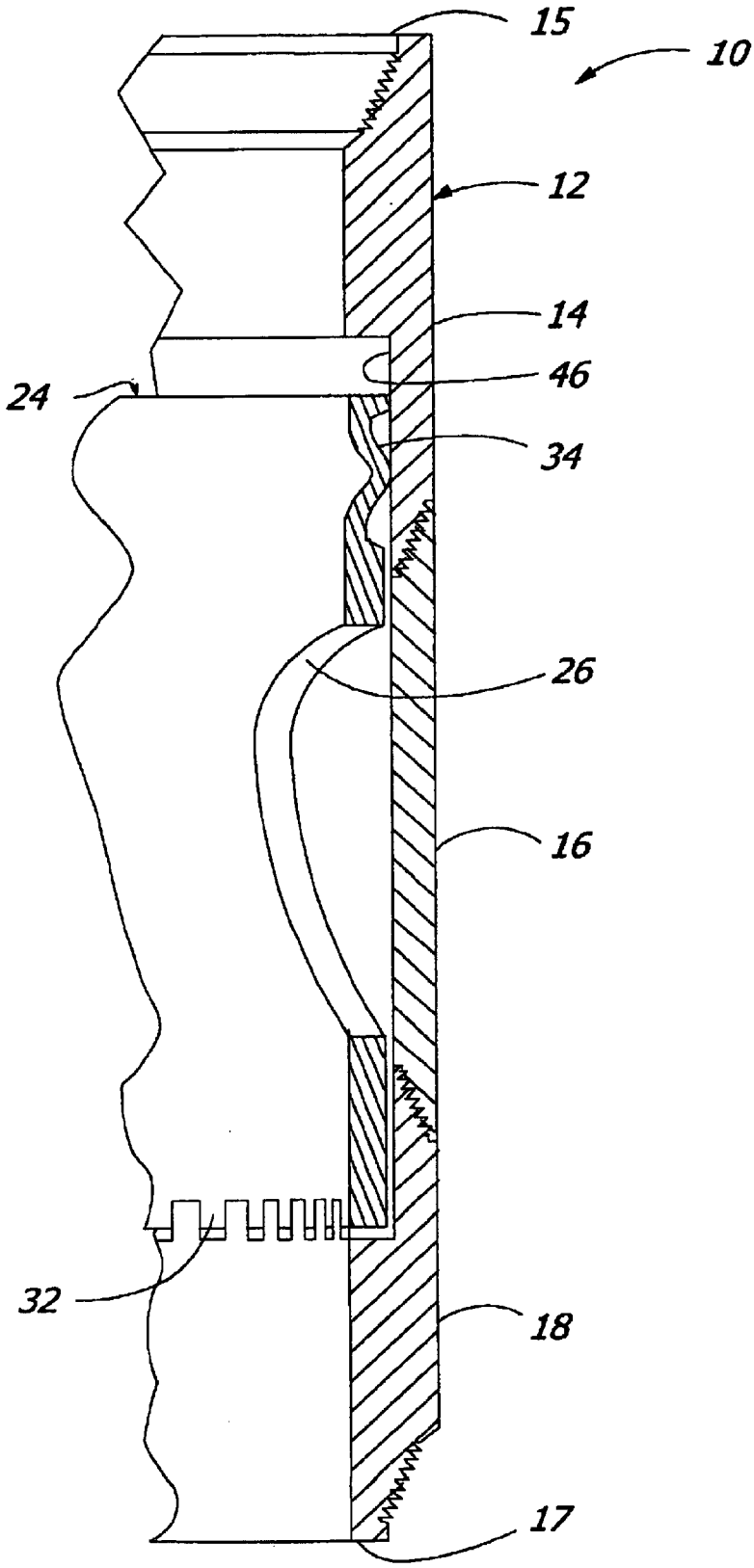
FIG. 2 is a quarter section view of the joint of FIG. 1 in the set position.

Sleeve 24 is rotationally and axially relatively free within recess 46 when it is not retained. Sleeve 24 can be retained by a number of different means including shear screws (for run in) and a clutch mechanism, a body lock ring, c-rings, locking dogs or swaging (for set position). The rotational freedom of sleeve 24 allows for orientation of sleeve 24 within casing joint 12 to orientate window 26 in any direction within a full 360° of rotation. There is no mechanical restriction of sleeve 24 prior to retaining it but in some embodiments hereof not all of section 16 is a drillable material, there may be a practical limit to orientation of sleeve 24 since the benefit of the invention is most readily obtained if the premachined window 26 is not aligned with the easily drillable material. The sleeve 24 is then retainable in the desired orientation by one of the retention means stated above, any combination of means including one of those listed above or other means which function to prevent unwanted rotational and axial movement of sleeve 24 thereby maintaining a set orientation for window 26. For purposes of example, FIGS. 1 and 2 illustrate a retention combination employing a clutch mechanism 32 at the downhole end of sleeve 24 comprising a plurality of teeth 30 on a downhole portion of sleeve 24 and a plurality of complementary teeth 28 on the I.D. of recess 46, and a swageable section 34 at an uphole end of sleeve 24. The teeth 28, 30 are engageable in any orientation of sleeve 24 and when in the engaged position will not allow the sleeve 24 to rotate. An advantage of the illustrated combination is that clutch mechanism 32 may be engaged and disengaged multiple times if desired prior to swaging section 34 and rendering the orientation permanent. Other mechanisms or combinations will provide the retention necessary but may not allow for multiple orienting tries before becoming permanent. These means of retention would be selected for other reasons relating to a particular application.

Referring still to FIG. 1, run in and setting are described. Casing segment 12 is made up with sleeve 24 preinstalled. The sleeve is located within recess 46 proximate an uphole end 56 thereof and retained there with a releasable means such as one or more shear screws (not shown). The joint 12 is then run in the hole and when it is on depth a conventional cementing operation is carried out such as long string cementing or inner string cementing. It should be noted that if long string cementing is employed, the I.D. of sleeve 24 is desirably protected from the cement lest it become stuck within joint 12 and thereby potentially unusable. One way of protecting the sleeve is to coat it with a substance to which cement will not adhere. Polytetrafluoroethylene is one such substance. Alternatively, if an inner string cementing technique is employed, no protection of sleeve 24 will be necessary. The entire cementing operation is then completed.

One of ordinary skill in the art will note from the foregoing that the joint is cemented in place without any consideration for the orientation thereof. This is possible, in this embodiment, because of the 360° easily drillable portion of section 16 and the subsequently orientable sleeve discussed above. The operation and configuration of the joint 12 facilitates the cementing operation without orientation thereby reducing completion time and its inherent difficulty. Moreover, since the casing itself never needs orientation the difficulties inherent in turning a casing string are completely avoided. Because of this capability it is significantly easier and more economical than past methods and configurations to run several joints of the type described herein leaving options open as to whether or not to use such joints for lateral junction. Once the casing is cemented in place, and subsequent to a decision to use a particular joint 12, a tool (not shown) is run in the hole to engage the sleeve 24. Weight is slacked on the sleeve defeating the shearable means (not shown) whereafter sleeve 24 is freely orientable pursuant to input from the surface. Window 26 in sleeve 24 may be oriented in any direction (360°) desired providing section 16 includes 360° of drillable material or is entirely so constructed. Once orientation is satisfactory the sleeve is locked in place, see FIG. 2, both rotationally and axially. The example of FIG. 2 illustrates a clutch mechanism 32 on the downhole end and swage 34 at the uphole end. FIG. 2 illustrates the sleeve in a permanently installed condition. It is noted that the swaged connection whether at uphole or downhole end must be deformed sufficiently (by conventional inflatable element techniques) to create stress between the sleeve and casing section 14 or 18 or both to prevent relative movement. Some of the other possible methods for retaining downhole end uphole end or both are noted above. It is noted that regardless of the types of connections used for sleeve 24, both uphole and downhole ends should be connected. This will ensure that the junction created will remain stable even if the easily drillable material section (16) deteriorates over time. In addition, sealing bands (not shown) of a material such as rubber can also be employed to enhance the seal between a swaged section of the sleeve and the casing. In such embodiment the pressure integrity of the junction is enhanced which may be beneficial if the drillable material degrades over time.

Figure 3:
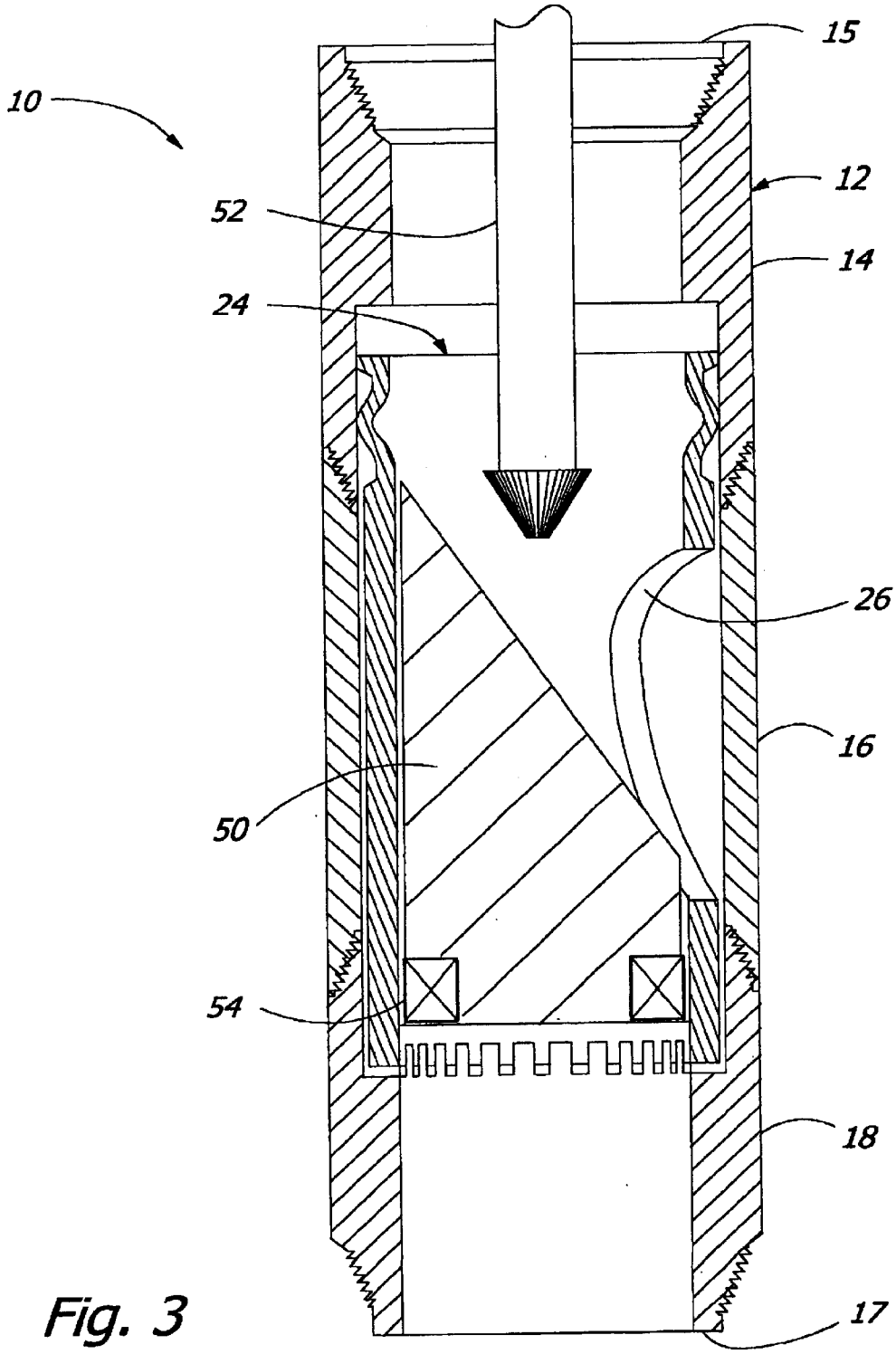
FIG. 3 is a cross-section view of a joint and sleeve with a diverter set to divert a drill string through the machined window of the sleeve to cut a window through the easily drillable section.

Referring to FIG. 3, once joint 12 is cemented and sleeve 24 oriented, a diverter 50 is run in the hole oriented and set at a location immediately downhole of window 26. Orientation of diverter 50 may be manual or may be automatic if a diverter anchor 54 (schematically illustrated) is in position downhole and the diverter possesses an orientation profile. A drill string 52 is then run off diverter 50. The drill string 52 is directed by diverter 50 through window 26 and into the easily drillable (at least portion of) section 16. The trajectory of drill string 52 is relatively stable due to the influence of both diverter 50 and window 26 which facilitates an exit opening with a well defined and formed shape thereby facilitating hanging and sealing a liner thereto. Hanging and sealing is further facilitated by sleeve 24 which as noted has a premachined window 26 intended and configured to mate with the liner system used. Once the casing exit (not shown) has been created, continued drilling with the same string creates the lateral borehole (not shown). A lateral liner (not shown) is run out window 26, out the casing exit (not shown), and into the lateral borehole (not shown) and seals against the sleeve and casing exit as discussed above. Any commercially available liner system such as a hook hanger or a sealed root system can be utilized.

There are several advantages of the disclosure. First, the junction can be deployed and cemented in a timely manner, as neither the casing string nor the window need to be oriented prior to cementing. Deploying more than one junction in a well bore is simplified, as the installed window sleeves can be oriented independently, after the casing is cemented in the ground. The known shape of the machined window, allows for a better fit with shaped liner tops, which creates a barrier to sand or other particulate matter infiltrating the well.

In addition, only the window sleeve needs to be oriented, which means the cementing process can begin as soon as the casing is on depth. The casing does not need to be oriented, which means it is easier to run multiple drillable casing joints in the ground, as they do not have to be oriented with each other prior to running; only the sleeve is required to be oriented. Significantly less effort is required to rotate the sleeve inside the casing than to rotate the casing in the borehole. This is because the sleeve to casing interface is metal to metal which has a low coefficient of friction whereas the casing to borehole interface has a higher coefficient of friction thus requiring more effort to turn not to mention the stress turning the casing places on all joints thereof. No stress is introduced by the turning of the sleeve due to reduced friction of steel on steel.

By having a window with a more uniform shape, the lateral liner and window interact to create a barrier that helps avoid formation sand or particles from entering the wellbore. The properly shaped window exhibits a known and easily controlled shape and size that lends itself to assurance that a commercially available liner hanger will seal thereagainst. Moreover, because the sleeve window is premachined, the shape and precise dimension thereof are known and specifically tailored to seal with the liner system intended to be employed. The seal of the liner may be by any number of methods, two preferred methods being by an elastomeric seal placed between the flange of the liner hanger and the sleeve, and a metal-to-metal interference fit resulting in deformation of the window sleeve outward during installation of the liner.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed is:

1. A drillable junction segment comprising:

a casing segment having at least a portion thereof constructed of an easily drillable material; and a sleeve disposed in said casing segment wherein the sleeve is orientable subsequent to cementing of the casing segment.

2. A drillable junction segment as claimed in claim 1 wherein said portion is cylindrical.

3. A drillable junction segment as claimed in claim 2 wherein said portion is centrally located in said segment.

4. A drillable junction segment as claimed in claim 1 wherein said material is selected from one of aluminum, fiber filled plastic, reinforced plastic or phenolic resin and combinations with at least one of the foregoing.

5. A drillable junction segment as claimed in claim 1 wherein said sleeve is thin walled.

6. A drillable junction segment as claimed in claim 1 wherein said sleeve includes a premachined window, said sleeve being orientable independently from said casing segment.

7. A drillable junction segment as claimed in claim 1 wherein said sleeve resides in a recess within said segment and said sleeve inside dimension is substantially identical to said segment inside dimension.

8. A drillable junction segment as claimed in claim 1 wherein said sleeve is constructed of a hard malleable material.

9. A drillable junction segment as claimed in claim 1 wherein said sleeve is constructed of steel.

10. A drillable junction segment as claimed in claim 1 wherein said sleeve is a thickness of about 0.125 to about 0.250 inch.

11. A drillable junction segment comprising:

a casing segment having at least a portion thereof constructed of an easily drillable material;

a sleeve disposed in said casing segment wherein said sleeve is axially and rotationally lockable to said casing segment.

12. A drillable junction segment as claimed in claim 11 wherein said sleeve is lockable by swaging.

13. A drillable junction segment as claimed in claim 11 wherein said sleeve is lockable by a clutch mechanism.

14. A drillable junction segment comprising:

a casing segment having at least a portion thereof constructed of an easily drillable material;

a sleeve disposed in said casing segment wherein said casing segment and said sleeve each include a plurality of teeth complementary to one another to selectively rotationally lock said sleeve relative to said casing segment.

15. A drillable junction segment comprising:

a casing segment having at least a portion thereof constructed of an easily drillable material;

a sleeve disposed in said casing segment wherein said sleeve is coated with a material to prevent cement adhesion to said sleeve.

16. A drillable junction segment as claimed in claim 15 wherein said material is polytetrafluoroethylene.

17. A method for creating a casing exit comprising:

installing a casing segment having at least a portion thereof constructed of an easily drillable material, said segment including a sleeve with a premachined window disposed therein;

cementing the casing segment orienting said premachined window after cementing the casing segment; and drilling said casing exit through said easily drillable material.

18. A method for creating a casing exit as claimed in claim 17 wherein said installing is carried out without orienting said casing segment.

19. A method for creating a casing exit as claimed in claim 17 wherein said installing includes cementing said casing segment.

20. A method for creating a casing exit as claimed in claim 17 wherein said orienting occurs after cementing of said casing segment.

21. A method for creating a casing exit as claimed in claim 17 wherein said drillable material is selected from aluminum, fiber filled plastic, reinforced plastic or phenolic resin and combinations with at least one of the foregoing.

22. A well system comprising:

a casing string having at least one segment with an easily drillable portion; and a sleeve having a premachined window therein disposed at said segment, said sleeve being orientable subsequent to cementing of the segment.

23. A well system as claimed in claim 22 wherein said system further comprises a lateral borehole extending from a junction with said casing string, said junction intersecting said easily drillable portion.

24. A well system as claimed in claim 23 wherein said system further comprises a lateral liner system engaged with said sleeve to create a particulate matter free junction.

25. A well system comprising:

a primary cased borehole wherein the casing includes a plurality of non-oriented casing segments at least a portion of each of which is an easily drillable material; and a sleeve disposed at each of said segments, each said sleeve having a premachined window therein, said sleeve being orientable to a desired orientation subsequent to cementing of the segments in place.

26. A drillable junction joint comprising:

a primary wellbore casing segment having a soft section that can be drilled using a standard drilling bit; and a sleeve having a pre-machined window, said sleeve being disposed inside said casing segment, said window being aligned with said soft section and orientable subsequent to cementing of the casing segment.

27. A method for drilling a casing exit at a wellbore comprising:

running a casing into said wellbore, said casing comprising a soft section that can be drilled using a standard drilling bit and a preinstalled sleeve that comprises a pre-machined window located at said soft section;

cementing said casing;

orienting said sleeve after said cementing;

passing through said pre-machined window and drilling through said soft section.

* * * * *